US007828254B2

(12) United States Patent
Stephens-De Alanis

(10) Patent No.: US 7,828,254 B2
(45) Date of Patent: Nov. 9, 2010

(54) HAIR ACCESSORY HOLDER AND ORGANIZER

(76) Inventor: Stephanie K. Stephens-De Alanis, 4 Daventry La., San Antonio, TX (US) 78257

( * ) Notice: Subject to any disclaimer, the term of this patent is extended or adjusted under 35 U.S.C. 154(b) by 0 days.

(21) Appl. No.: 12/413,184

(22) Filed: Mar. 27, 2009

(65) Prior Publication Data

US 2010/0243829 A1 Sep. 30, 2010

(51) Int. Cl.
*F16M 13/00* (2006.01)

(52) U.S. Cl. ..... 248/158; 248/309.4; 248/121; D8/363; 211/30

(58) Field of Classification Search ..... 248/206.5, 248/117.1, 117.2, 176.2, 309.4, 176.1, 90, 248/301, 304, 159, 158, 126, 127, 121; D8/363; 211/30, 32, 33
See application file for complete search history.

(56) References Cited

U.S. PATENT DOCUMENTS 201,656 A * 3/1878 Dunn ..... 242/136
318,657 A * 5/1885 Richards ..... 211/106.01
333,741 A * 1/1886 Frank ..... 211/32
357,192 A * 2/1887 Foster ..... 211/32
378,201 A * 2/1888 Jacoby ..... 248/304
500,745 A * 7/1893 Rogers ..... 211/30
539,194 A * 5/1895 Savoie ..... 211/32
542,255 A * 7/1895 Henkel ..... 248/304
577,528 A * 2/1897 Kachler ..... 211/85.13
657,629 A * 9/1900 Visel ..... 211/30
710,805 A * 10/1902 Riley ..... 211/33
711,253 A * 10/1902 Martin ..... 211/33
720,833 A * 2/1903 Messick ..... 211/85.3
743,276 A * 11/1903 Hammack ..... 211/85.3
807,904 A * 12/1905 Billings ..... 211/33
846,956 A * 3/1907 Shaw ..... 211/32
D39,209 S * 3/1908 Larson ..... D6/458
909,114 A * 1/1909 Pitts ..... 211/9
928,213 A * 7/1909 Patterson ..... 248/121
1,124,714 A * 1/1915 Denning ..... 211/33
1,221,517 A * 4/1917 Dunbar ..... 211/70
2,270,331 A * 1/1942 Noble ..... 335/285
2,310,439 A * 2/1943 Johnson ..... 211/32
D152,038 S 12/1948 Stauber
2,639,820 A * 5/1953 Lee ..... 211/163
2,887,988 A * 5/1959 Cottongim ..... 119/57.9
3,019,910 A 2/1962 Greene
3,108,723 A * 10/1963 Hickey ..... 223/66
3,776,387 A * 12/1973 Brent ..... 211/70.6
D230,037 S 1/1974 Hawn
3,997,050 A 12/1976 Patterson
4,390,099 A * 6/1983 Trautlein et al. ..... 211/4

(Continued)

*Primary Examiner*—Kimberly T Wood
(74) *Attorney, Agent, or Firm*—Robert L. McRae; Gunn, Lee & Cave, P.C.

(57) ABSTRACT

A hair accessory organizer for holding many different types of hair accessories. The hair accessory organizer is magnetized to hold hair accessories either wholly or partially made of metal. In addition, the hair accessory organizer holds non-metal hair bands and hair accessories. The hair accessory organizer is capable of resting on a countertop, in a drawer or hung on a wall or door. The hair accessory organizer has a curved top member that holds substantially "U" shaped hair bands both on its top surface, and on its bottom surface. Two rings allow for attachment sites of hair clips and hooks. The hooks provide attachment sites for elastic hair bands and the like.

6 Claims, 4 Drawing Sheets

U.S. PATENT DOCUMENTS

| | | | | | |
|---|---|---|---|---|---|
| D301,407 | S | | 6/1989 | Boeri | |
| D318,590 | S | | 7/1991 | McKeone | |
| 5,031,777 | A | | 7/1991 | Knox | |
| 5,168,985 | A | | 12/1992 | Shih | |
| D354,310 | S | | 1/1995 | Crist | |
| D354,874 | S | | 1/1995 | Burch | |
| 5,452,806 | A | | 9/1995 | Campas | |
| 5,535,895 | A | * | 7/1996 | Valiulis | 211/59.1 |
| 5,630,517 | A | * | 5/1997 | Maznik | 211/70.6 |
| D379,892 | S | * | 6/1997 | Burns | D6/566 |
| D394,918 | S | | 6/1998 | Gillmore | |
| 5,833,080 | A | * | 11/1998 | Donne | 211/85.31 |
| 5,848,710 | A | * | 12/1998 | Pomper | 211/85.2 |
| D417,115 | S | | 11/1999 | Creel | |
| D437,711 | S | | 2/2001 | Berg | |
| 6,227,633 | B1 | | 5/2001 | Castillo | |
| D454,412 | S | | 3/2002 | Riley | |
| D456,176 | S | | 4/2002 | Dashefsky | |
| D457,271 | S | | 5/2002 | Jackson | |
| 6,601,714 | B2 | | 8/2003 | Bladek | |
| 6,672,463 | B2 | | 1/2004 | Dashefsky | |
| 6,682,035 | B1 | | 1/2004 | Hart | |
| 6,688,316 | B1 | | 2/2004 | Klug | |
| 6,991,118 | B2 | | 1/2006 | Phillips | |
| 7,028,853 | B1 | | 4/2006 | Simms | |
| D532,994 | S | | 12/2006 | Rice | |
| D575,005 | S | | 8/2008 | Gomez | |
| 2004/0164034 | A1 | | 8/2004 | Costanza | |
| 2004/0188368 | A1 | | 9/2004 | Hildreth | |
| 2005/0194334 | A1 | | 9/2005 | Johnson | |
| 2005/0218090 | A1 | | 10/2005 | Sepanek | |
| 2005/0258116 | A1 | | 11/2005 | Mandelbaum | |

* cited by examiner

HAIR ACCESSORY HOLDER AND ORGANIZER

BACKGROUND OF THE INVENTION

1. Field of the Invention

The present invention relates to hair accessories such as hair bands barrettes and hair clips, and more specifically, to an organizer or holder for storing and maintaining various types of hair accessories. The hair organizer of the present invention provides storage of metallic and non metallic hair accessories, and can be placed on a countertop, in a drawer, or on a wall or door. Storage of the hair accessories allows for less clutter and more space in bathroom or bedroom drawers.

2. Description of the Related Art

There exists in the prior art hair accessory and bow organizers, jewelry containers and boxes, vanity racks and the like. Many of the prior art organizers have drawers and compartments, and contain several movable parts. These drawers and compartments hold excess hair accessories that otherwise are not accommodated on the organizer. As a result, elastic hair bands, barrettes and the like are thrown into these drawers, making a tangled mess of the hair accessories.

Other organizers are equipped to handle a particular type of hair accessory such as a bow or a hair band, but are not versatile to accommodate several different types of hair accessories. Still other organizers are bulky and not stowable in a drawer or on a countertop without taking up substantial space. Other prior art organizers are not attachable to a wall or door. Some prior art organizers have multiple stackable parts such that a user must remove at least one stackable part to store a hair accessory. Other prior art organizers have elaborate storage spaces to store hair bands and the like with hinged doors to hide the storage spaces.

Yet, none of the prior art devices provide a hair accessory organizer that is capable of holding and storing virtually every type of hair accessory and is easy to access and store such hair accessories without need of moving various parts, or open doors or drawers. Moreover, none of the prior art provides such a versatile organizer is easily stowable on a counter top, on a wall or door, or in a drawer.

BRIEF SUMMARY OF THE INVENTION

The present invention is different than the prior art. The hair accessory organizer of the present invention is designed to accept and hold any type of existing hair accessory available. Elastic hair bands, barrettes, hair clips, ponytail holders, bows, hair claws, and the like can easily be stored on the present invention without need for separate specially made compartments to store differing hair accessories. The preferred embodiment of the present invention rests on a vanity, a night stand, or a countertop. A base member is attached to a support member. The support member is a vertical elongated cylinder extending vertically from the base member. On the end of the vertical member opposite the base member, a first ring member is attached. The first ring member extends vertically upward away from the support member.

A second ring member is spaced from the first ring member and attached thereto by a plurality of hanging members. The second ring member and first ring member are substantially parallel to one another. The hanging members are horizontally disposed between the first ring member and second ring member. The end portions of the hanging members are attached to the first ring member and second ring member thereby attaching the second ring member to the first ring member.

The second ring member is further attached to the first ring member by a curved top member. The top member is curved downward at the appropriate curvature to receive a portion of the outer curved surfaces of the first ring member and second ring member. The top member is attached to the second ring member at an end portion such that the top member does not substantially extend beyond the second ring member. The top member extends between the first ring member and second ring member and is attached to the first ring member at an approximate middle portion of the top member relative to a longitudinal axis. Thereafter the top member extends outward, substantially horizontally from the first ring member.

In an alternative embodiment, the base member of the hair accessory organizer has a vertical portion to receive a first end of the support member. The base member has a horizontal member perpendicular to the vertical portion and ends in an attaching portion. The attaching portion likewise is perpendicular to the vertical member, and provides an attachment site to allow the organizer to be attached to a wall or door. The support member extends vertically upward from the vertical portion of the base member, and attaches to the top member at the approximate middle portion thereof relative to the longitudinal axis.

A ring member is substantially vertically oriented and spaced from the support member. The top member is attached to the ring member along an end portion of the top member. The top member extends substantially beyond the support member in the horizontal direction. However, the top member does not substantially extend beyond the ring member. A plurality of hooks are placed on the ring member and extend substantially toward the support member for hanging elastic hair bands and the like.

In another alternative embodiment, the base member is elongated and has a first support rod, a second support rod and a third support rod thereon. All three support rods are spaced from one another and substantially perpendicular to the flat top surface of the base member. A first ring member is attached to the first support rod at the end opposite the base member, and extends upward away from the base member. Likewise, a second ring member is attached to the second support rod at the end opposite the base member and extends upward away from the base member. The first ring member and the second ring member are substantially parallel to one another.

A plurality of hanging members extend between and attach to the first and second ring members. The hanging members are substantially horizontally oriented and substantially parallel to one another. A top member is attached to the first and second ring members, and extends outward from the first ring member. The first ring member is attached to the top member at the approximate middle portion thereof relative to the longitudinal axis. The second ring member is attached to an end portion of the top member, and the top member does not substantially extend beyond the second ring member.

A hanging rod is perpendicularly attached to the third support rod and extends horizontally outward there from, away from the second support rod and second ring member. The hanging rod has a plurality of hooks disposed thereon for hanging elastic hair bands and the like. The base member can be hung on a wall or door such that the top member is oriented on the top portions of the first and second ring members. However, it is not absolutely necessary that this embodiment be hung on a door or wall. It is possible to simply place the organizer on a countertop. In such a situation, the top member would be oriented on a side portion of the first and second ring member.

In another embodiment, the organizer is designed to be placed on a countertop or in a drawer. The base member is substantially square or rectangular. First and second receiving members are disposed on and attached to the top surface of the base member, substantially opposed to one another such that the first and second receiving members curve such that their end portions are oriented toward the inner portion of the base member. A plurality of rods are disposed along a side adjacent the first and second receiving members. First and second hooks are disposed along the side opposite the plurality of rods, and are spaced from the first and second receiving member. First and second pins are disposed at two adjacent corners, respectively.

DETAILED DESCRIPTION OF THE INVENTION

Figure 1:
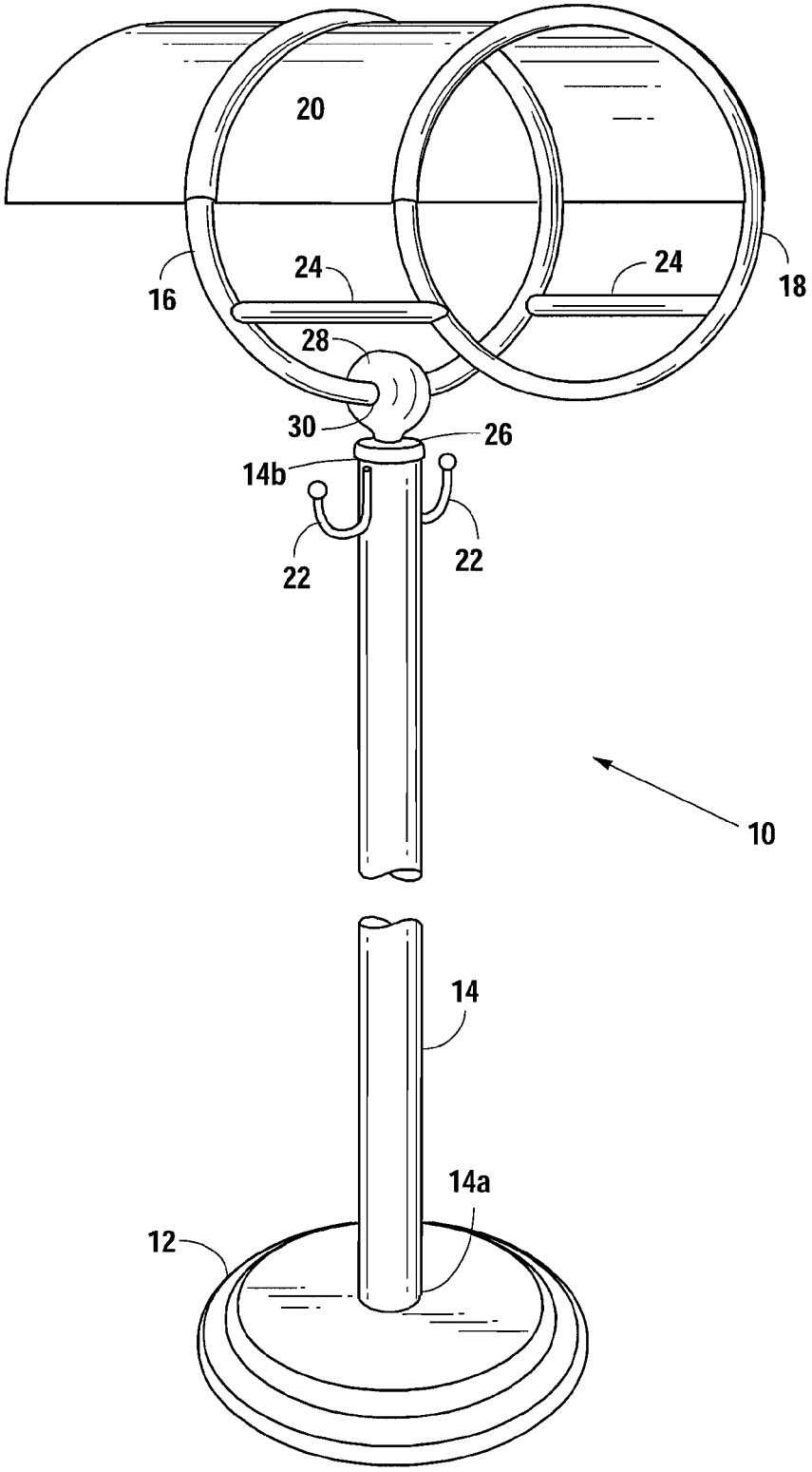
FIG. 1 is a perspective view of the preferred embodiment of the hair accessory organizer of the present invention.

Referring to FIG. 1, the preferred embodiment of the present invention is disclosed. The hair accessory organizer 10 has a base member 12, a support member 14, a first ring member 16, a second ring member 18 and a top member 20. Support member 14 is cylindrically shaped and elongated having a first end 14*a* and a second end 14*b*. As shown, base member 12 is substantially circular. However, base member could be any suitable shape to support the hair accessory organizer 10 on a countertop, vanity, or on a shelf. First end 14*a* of support member 14 is attached to base member 12 at substantially the center portion of base member 12. This allows for even weight distribution of the hair organizer 10 on the base member 12.

Support member 14 is perpendicular to base member 12 extends substantially vertically from base member 12, terminating at second end 14*b*. Although shown as being elongated and cylindrically shaped, support member 14 could be of any shape such as triangularly elongated or square shaped and elongated. A pair of hooks 22 are attached to an upper portion of support member 14, just below second end 14*b*. However, as discussed herein below, the hooks 22 could be placed on first ring member 16, second ring member 18 or hanging members 24 alternatively, or in addition to being placed on support member 14. A cap portion 26 is attached around the circumference of second end 14*b* and caps support member 14. A receiving ball 28 is attached to cap portion 26 and extends vertically there from. A hole 30 extends through receiving ball 28.

First ring member 16 is disposed adjacent the second end 14*b* of support member 14. A lower portion of first ring member 16 is disposed through hole 30 of receiving ball 28. Although shown and described as being attached to support member 14 via receiving ball 28, any suitable attachment could be used to attach first ring member 16 to support member 14. Moreover, a hole could be placed through support member 14 along second end 14*b* for first ring member 16 to pass there through, thereby eliminating the need for cap portion 26 and receiving ball 28, or any other attachment, altogether. First ring member 16 extends substantially vertically upward from support member 14.

Second ring member 18 is spaced from first ring member 16 and attached to first ring member 16 via a plurality of hanging members 24. Hanging members 24 are disposed between first ring member 16 and second ring member 18, and attach to first ring member 16 and second ring member 18 along the end portions of hanging members 24, thereby attaching the lower portion of second ring member 18 to first ring member 16. Although shown as having two hanging members 24, hair accessory organizer 10 could have more than two hanging members 24 between first ring member 16 and second ring member 18. Moreover, as previously discussed, although hooks 22 are shown as fixedly attached to support member 14, it is possible to add hooks 22 to first ring member 16, second ring member 18 or hanging members 24. Moreover, hooks 22 could be "S"-shaped hooks that can be movably attached to first ring member 16, second ring member 18 or hanging members 24.

Top member 20 is generally curved downward and is of a curvature that corresponds to the curvature of top portions of first ring member 16 and second ring member 18. One end portion of top member 20 is formed to receive a top portion of second ring member 18. Likewise, top member 20 is formed at approximately the middle portion relative to the longitudinal axis of the top member 20 to receive a top portion of first ring member 16. From first ring 16, top member 20 extends horizontally outward, away from first ring member 16. While top member 20 is shown and described as being of the appropriate curvature to receive first ring member 16 and second ring member 18, it should be readily appreciated that the curvature of top member 20 is also appropriate to receive a typical substantially "U" shaped head band (not shown).

Furthermore, in the preferred embodiment, top member 20 is made of a magnetized metal material. Magnetizing top member 20 allows for secure placement of metal or partially metal hair bands on the top surface of top member 20. Furthermore, metal or partially metal hair band may be placed on the underside of top member 20 and suspended thereto due to the magnetic property of top member 20. The formed portions of top member 20 which receive first ring member 16 and second ring member 18 further provide stops for non-metal hair bands so that such hair bands do not readily slide off of top member 20 during movement from one location of the countertop to another location of the countertop. Furthermore, base member 12 can also be made of a magnetized metal to allow smaller metal barrettes and bobby pins to be magnetically secured thereto.

Figure 2:
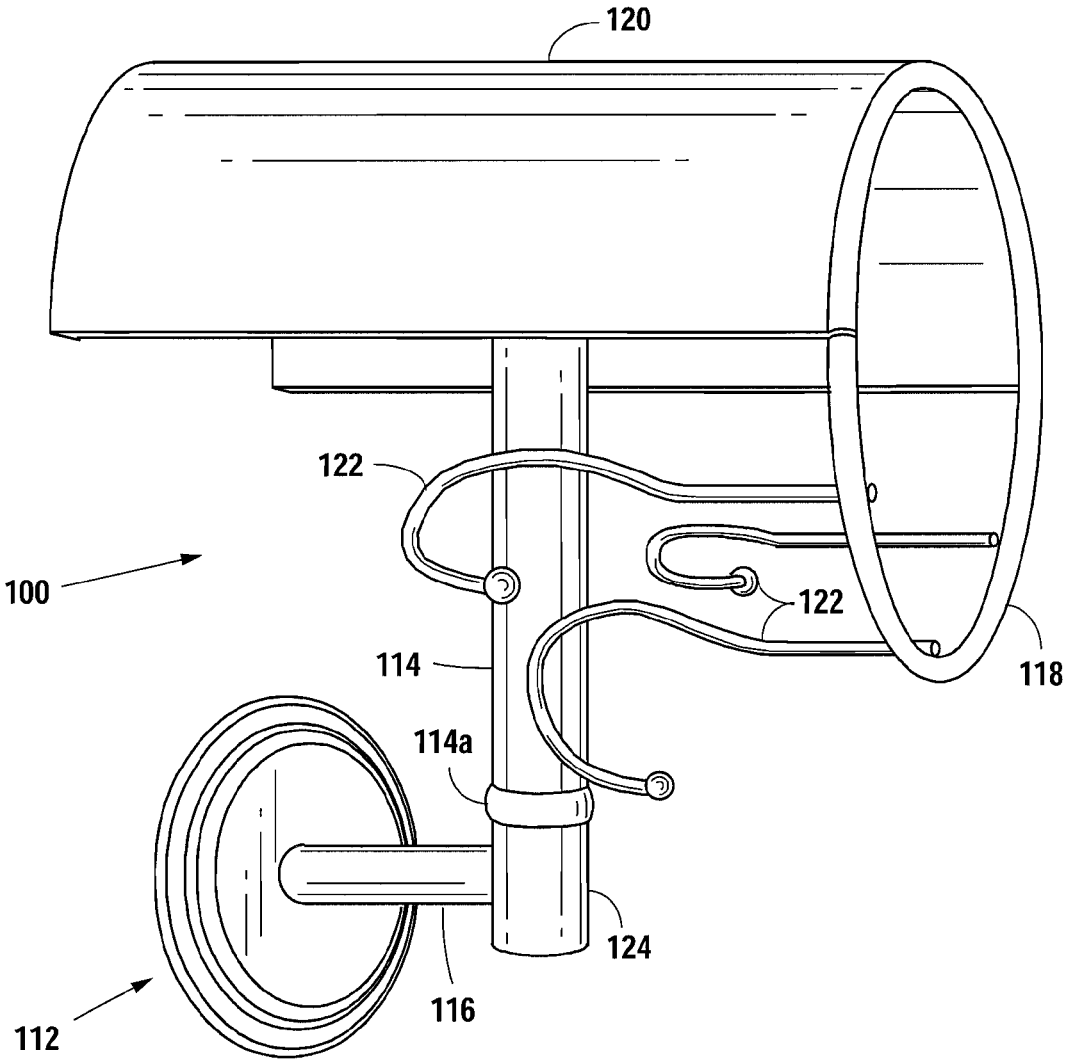
FIG. 2 is a perspective view of an alternative embodiment of the hair accessory organizer of the present invention.

Referring to FIG. 2, an alternative embodiment of the hair accessory organizer 100 is disclosed. Base member 112 of hair accessory organizer 100 is designed to be hung on a wall or a door. Base member 112 can be secured directly to the wall or door by inserting attaching devices such as nails or screws (not shown) through two apertures (not shown) in base member 112. Alternatively, base member 112 can be attached to a wall or door by attaching a holding bracket (not shown) to the wall or door with a nail or screw (not shown) and attaching base member 112 to the holding bracket and securing thereto by tightening a small securing screw (not shown) which is disposed on an outer rim of base member 112 and oriented to tighten inward toward the center of the circular part of base member 112 to grip base member 112 to the holding bracket in the same manner that a typical towel rod is attached to a wall.

Base member 112 has a horizontal member 116 perpendicularly attached to base member 112 and extending substantially horizontally outward. A vertical member 124 is perpendicularly attached to the horizontal member 116 and extends vertically upward. Vertical member is cylindrically shaped and open on the upper end to receive first end 114*a* of support member 114. Support member 114 is inserted into the upper end of vertical member 124 and attached thereto. Top member 120 is attached directly to the second end of support member 114 opposite first end 114*a*. Top member 120 is attached to support member 114 at the approximate middle portion relative to the longitudinal axis of top member 120.

A ring member 118 is disposed adjacent top member 120. An end portion of top member 120 is formed to receive a top portion of ring member 118. Like top member 20 in the preferred embodiment, top member 120 is a substantially downwardly curved sheet member and is of a curvature that corresponds to the curvature of the top portion of ring member 118. A plurality of hooks 122 are attached to ring member 118 and extend inwardly toward support member 114. However, hooks 122 could be oriented to extend outward, away from support member 114. Like the preferred embodiment, top member 120 is made of a magnetized metal to magnetically attract metal hair bands or metal portions of hair bands either on top member's top surface or bottom surface, thereby magnetically securing the hair band to top member 120.

Referring to FIG. 1 and FIG. 2, it is contemplated that base member 112 of the embodiment in FIG. 2 could replace base member 12 in FIG. 1, thereby allowing the hair accessory organizer 10 to be secured to a wall or door. Likewise, base member 12 could replace base member 112 in FIG. 2 to allow the hair accessory organizer 100 to be placed on a countertop. Moreover, rather than attaching directly to top member 120, support member 114 could have an additional ring member attached to the end opposite first end 114*a*, which then attaches to top member 120, as shown in FIG. 1.

Figure 3:
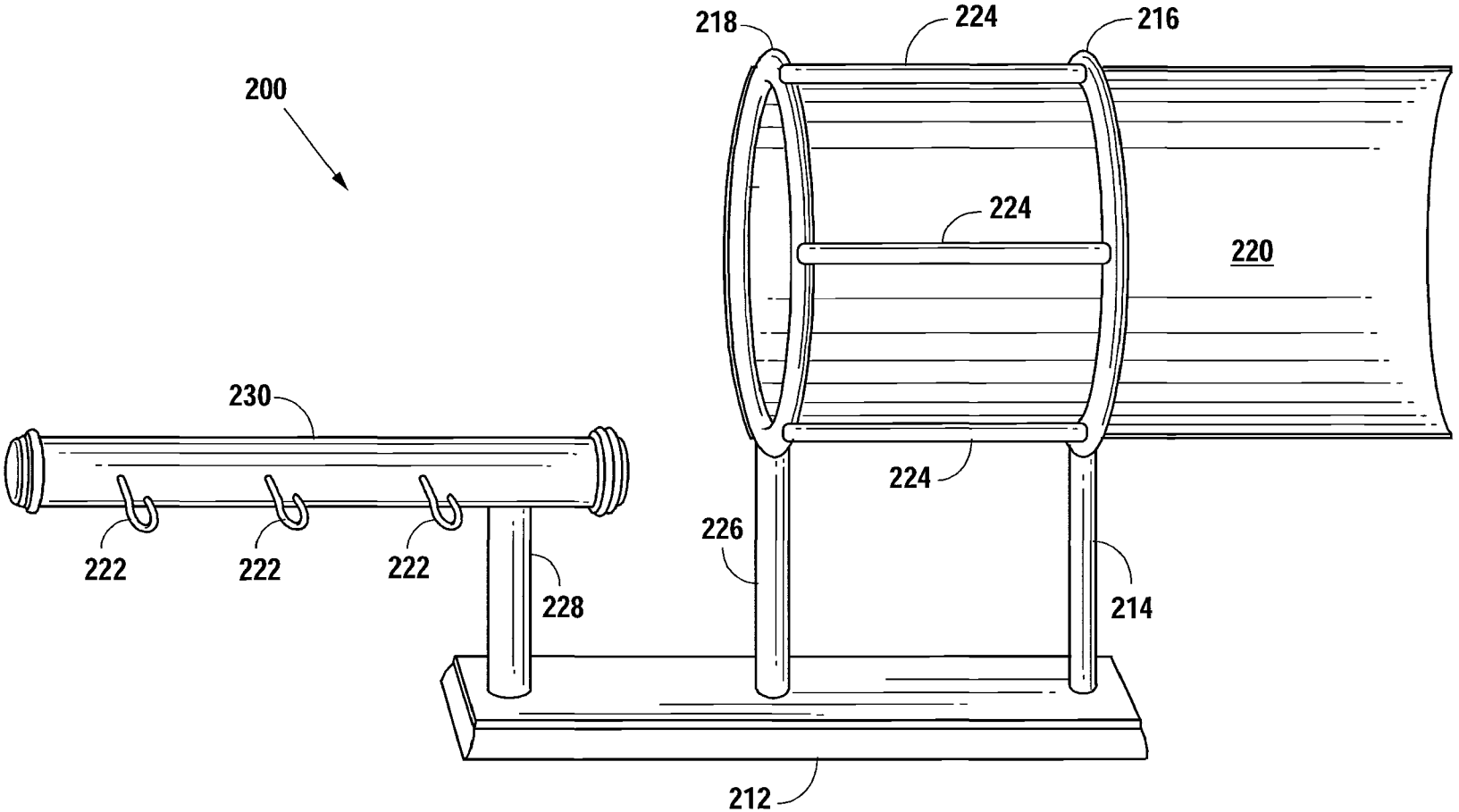
FIG. 3 is a perspective view of another alternative embodiment of the hair accessory organizer of the present invention.

Referring to FIG. 3, another embodiment of the hair accessory organizer 200 of the present invention is disclosed. The hair accessory organizer 200 has an elongated, generally rectangular base member 212. Base member 212 can be placed on a countertop or hung on a wall or door in the same manners described hereinabove with regard to the embodiment shown in FIG. 2.

Returning to FIG. 3, a first support rod 214, a second support rod 226 and a third support rod 228 are spaced from one another and perpendicularly attached to base member 212. First ring member 216 is attached to an end portion of first rod member 214 opposite base member 212, and extends vertically upward there from. Second ring member 218 likewise is attached to an end portion of second rod member 226 opposite base member 212, and extends vertically upward there from. A plurality of hanging members 24 are substantially horizontally disposed between first ring member 216 and second ring member 218, and are attached at their end portions to first ring member 216 and second ring member 218.

A top member 220 is attached to top portions of first ring member 216 and second ring member 218. Top member 220 is generally curved downward and is of a curvature that corresponds to the curvature of top portions of first ring member 216 and second ring member 218. One end portion of top member 220 is formed to receive a top portion of second ring member 218. Likewise, top member 220 is formed at approximately the middle portion relative to the longitudinal axis of the top member 220 to receive a top portion of first ring member 216. From first ring member 216, top member 220 extends horizontally outward, away from first ring member 216. It should be readily understood that when base member is attached to a wall or door, top member 220 will be oriented along top portions of first ring member 216 and second ring member 218. However, if placed on a countertop, top member 220 will be disposed sideways, as shown in FIG. 3. Because top member 220 is made of a magnetized metal, the orientation of top member 220 will not affect the ability of top member 220 to hold metal hair bands or metal parts of hair bands, regardless of whether the hair accessory organizer 200 is placed on a countertop or hung on a wall or door.

A hanging rod 230 is perpendicularly attached to third support rod 228, and extends substantially horizontally away from second ring member 218. Hanging rod 230 provides an attachment site for hair clips and the like. Furthermore, a plurality of hooks 222 are disposed along hanging rod 230 to attach elastic hair bands and the like. It is further disclosed that hanging rod 230 and/or base member 212 can be made of magnetized metal to hold barrettes, bobby pins, and other metallic or partially metallic hair accessories.

Figure 4:
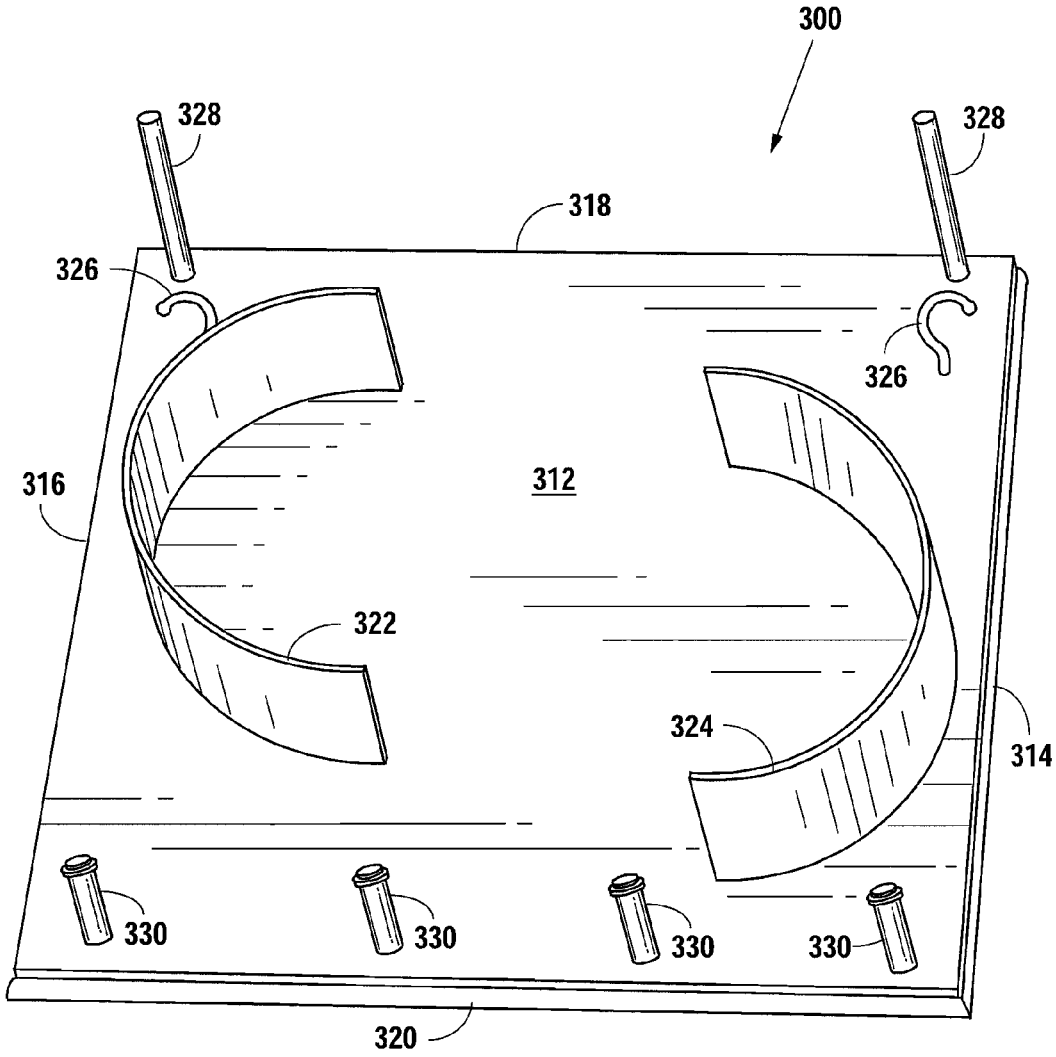
FIG. 4 is a perspective view of another alternative embodiment of the hair accessory organizer of the present invention.

Referring to FIG. 4, another embodiment of the hair accessory organizer 300 is disclosed. Hair accessory organizer 300 is designed to be placed on a countertop or in a drawer. Hair accessory organizer 300 has a substantially rectangular or square base member 312 with a first side 314, a second side 316 parallel and opposite the first side 14, a third side 318 adjacent the first side 314 and second side 316, and a fourth side 320 opposite third side 318. A first receiving member 324 is disposed along first side 314 and curves toward the middle of base member 312. A second receiving member 322 is disposed along second side 316 and curves toward the middle of base member 312. As shown, first receiving member 324 and second receiving member 322 are opposite one another, but staggered so that "U" shaped hair bands can be placed on each receiving member 322 and 324 such that the ends of hair bands on opposing receiving members 322 and 324 do not touch one another. However, first receiving member 324 and second receiving member 322 could be directly opposite one another.

First receiving member 324 and second receiving member 322 are made of magnetized metal so that metallic hair bands are magnetically secured thereto to prevent movement or disengagement from receiving members 322 and 324. A plurality of rods 330 are disposed along fourth side 320. Preferably there are more than two rods 330 along fourth side 320 such that the distance between rods 330 is minimal. In this manner, smaller elastic hair bands (not shown) can be stored on the hair accessory organizer 300 by hooking the smaller elastic hair bands on consecutive rods 330 without over stretching the smaller elastic hair bands. Moreover, the plurality of rods 330 could be placed along third side 318, in which case hooks 326 and pins 328 would be located along fourth side 320.

Hooks 326 are disposed spaced from first receiving member 324 and second receiving member 322 along first side 314 and second side 316. Hooks 326 provide attachment sits for longer elastic hair bands (not shown) in the same manner as hanging the smaller hair bands as previously described. Pins 328 are disposed at the corners of base member 312 formed by first side 314 and third side 318, and second side 316 and third side 318, respectively. Pins 328 provide another attachment site for longer elastic hair bands. Furthermore, pins 328 provide an attachment site for hair clips. It is further contemplated that any or all of pins 328, hooks 326 and rods 330 could be made of magnetized metal to magnetically attach hair accessories either wholly or partially made of metal. Moreover, the entire base member 312 could be made of magnetized metal so that the entire surface of base member 312 could be used to store such hair accessories.

Although the invention has been described with reference to specific embodiments, this description is not meant to be construed in a limited sense. Various modifications of the disclosed embodiments, as well as alternative embodiments of the invention will become apparent to persons skilled in the art upon the reference to the description of the invention. It is, therefore, contemplated that the appended claims will cover such modifications that fall within the scope of the invention.

I claim:

1. A hair accessory organizer and holder comprising:

a vertical support member having a substantially cylindrical shape, a first end and second end;

a base member adjacent said first end of said support member having a vertical portion for receiving said support member, a horizontal member perpendicular to and attached to said vertical portion, a substantially circular attaching portion adjacent and end of said horizontal member opposite of said vertical portion, said attaching portion being attachable to a flat, substantially vertical surface;

a top member attached to said second end of said support member, said top member being a substantially downwardly curved sheet member and extending horizontally from said second end of said support member, said top member being attached substantially perpendicularly to said support member and covering said hair accessory organizer;

and at least one least one ring member attached to an end portion of said top member, said at least one ring member having a pre-defined top portion covered by said top member.

2. The hair accessory organizer and holder as recited in claim 1 further comprising a plurality of hooks fixedly attached to said ring member and extending inwardly toward said support member.

3. The hair accessory organizer and holder as recited in claim 2 wherein said plurality of hooks extend outward away from said support member.

4. The hair accessory organizer and holder as recited in claim 3 wherein said plurality of hooks extend outward away from said support member.

5. The hair accessory organizer and holder as recited in claim 2 wherein said plurality of hooks extend outward away from said support member.

6. The hair accessory organizer and holder as recited in claim 1 wherein said top member magnetized.

* * * * *